US005570659A

United States Patent [19]

Cohen

[11] Patent Number: 5,570,659

[45] Date of Patent: Nov. 5, 1996

[54] DOMESTIC GAS-FIRED BOILER

[75] Inventor: Kenneth Cohen, Fort Lee, N.J.

[73] Assignee: Slant/Fin Corpoiration, Greenvale, N.Y.

[21] Appl. No.: 314,914

[22] Filed: Sep. 28, 1994

[51] Int. Cl.[6] ..... F22B 5/00

[52] U.S. Cl. ..... 122/13.1; 122/14; 122/16; 122/17; 122/19; 126/361; 126/362

[58] Field of Search ..... 122/13.1, 14, 16, 122/17, 18, 19; 126/361, 362

[56] References Cited

U.S. PATENT DOCUMENTS 4,549,525 10/1985 Narang ..... 122/13.1
4,641,631 2/1987 Jatana ..... 122/14
5,311,843 5/1994 Stuart ..... 122/18
5,317,992 6/1994 Joyce ..... 122/14

*Primary Examiner*—Henry A. Bennett
*Assistant Examiner*—Siddharth Ohri
*Attorney, Agent, or Firm*—Herbert Dubno

[57] ABSTRACT

A high-efficiency wall-mounted boiler utilizes air/fuel control via a servovalve for the gas responsive to pressure drops across air and gas orifices measured to a common downstream pressure. A ceramic burner is floatingly held against its gasket and seals the combustion chamber while the blower is of adjustable speed to allow load modulation.

13 Claims, 4 Drawing Sheets

DOMESTIC GAS-FIRED BOILER

FIELD OF THE INVENTION

My present invention relates to a gas-fired domestic boiler and, more particularly, to a highly compact and efficient gas-fired boiler for domestic space and water-heating purposes, characterized by high efficiency, low fuel consumption, low emission of nitrogen oxides and improved monitoring and operational management.

BACKGROUND OF THE INVENTION

Domestic boilers for space heating and domestic hot-water heating are known in a variety of configurations and constructions and generally provide a burner forming a fuel-air mixture which is combusted in a combustion chamber which may form a heat exchanger with a medium to be heated, e.g. water which can be circulated for space heating purposes, a flue for discharging the combustion gases and a variety of controls for monitoring the combustion process.

By and large, such boilers are free-standing and in many cases can be relatively voluminous.

While more modern boilers have tended to occupy less space, generally they are lacking in versatility in the sense that they operate efficiently only at a fixed volume of gas or air flow and are not amenable to modulation to suit different operating conditions.

OBJECTS OF THE INVENTION

It is, therefore, the principal object of the present invention to provide an improved boiler of high reliability and efficiency and which is more versatile than earlier gas-fired boilers.

It is another object of this invention to provide an improved method of operating a gas-fired boiler so as to increase the versatility thereof and, in general, to provide improved boiler management.

Still another object of this invention is to provide a highly compact, high-efficiency boiler with low fuel consumption which is free from drawbacks of earlier boilers.

SUMMARY OF THE INVENTION

These objects and others which will become apparent hereinafter are attained, in accordance with the invention, in a gas-fired boiler which comprises:

a burner;

a combustion chamber receiving a combustible mixture from the burner and provided with a flue and means for heating water;

means for feeding a fuel gas to the burner through a gas-supply orifice;

means for feeding air for combustion of the fuel gas to the burner and into admixture with the fuel gas through an air orifice of a cross sectional area dimensioned relative to a cross sectional area of the gas-supply orifice to ensure complete combustion of the fuel gas in the burner;

means for detecting a pressure drop across the gas-supply orifice and a pressure drop across the air orifices; and a servovalve controlling flow of the fuel gas to the burner and provided with inputs representing the pressure drops, the servovalve regulating the flow to maintain the pressure drops equal with varying air-flow rates to the burner.

The invention also comprises an improved method of operating a gas-fired boiler and involves the steps of:

(a) feeding a fuel gas to a burner of the boiler through a gas-supply orifice;

(b) feeding air for combustion of the fuel gas to the burner and into admixture with the fuel gas through an air orifice of a cross sectional area dimensioned relative to a cross sectional area of the gas-supply orifice to ensure complete combustion of the fuel gas in the burner;

(c) detecting a pressure drop across the gas-supply orifice and a pressure drop across the air orifices and applying the detected pressure drops to a servovalve controlling flow of the fuel gas to the burner; and (d) regulating the flow with the servovalve to maintain the pressure drops equal with varying air-flow rates to the burner.

Both pressure drops are detected, in accordance with the invention, with a common downstream reference. The burner of the present invention, moreover, includes a porous ceramic burner body which is sealed in place in an opening of the combustion chamber. The burner body may be a porous ceramic block.

According to a feature of the invention, the porous ceramic burner body is mounted in the opening of the wall of the combustion chamber by pressing a metal frame against the body and the body against the wall via an appropriate pliable heat-resistant seal, utilizing a plurality of coil springs braced between brackets anchored to the wall and the frame.

According to another feature of the invention, the method comprises turning the boiler on and off to maintain a predetermined temperature range in space heated by the boiler, measuring a proportion of "on"-time of the boiler, and modulating a rate of flow of air to the burner in response to a measured proportion of the "on"-time, thereby varying heat output per unit time in response to demand.

The rate of flow of air to the burner is controlled by regulating a speed of an electric motor driving an air blower connected to the burner. While the boiler is capable of full modulation with respect to the rate of air supplied and the load met by the boiler within the range from zero to maximum, preferably the burner is operated in half-load and full-load modes and, upon the "on"-time per hour being less than a predetermined percentage, the burner is switched from full-load mode to half-load mode and upon the "on"-time per hour being more than a predetermined percentage, the burner is switched from half-load mode to full-load mode.

The advantages of the boiler of the present invention by comparison to prior art boilers include the ability to provide a fully integrated microprocessor-based control system which, as described, automatically switches between high and low gas-firing rates to match the changes it senses in heating load, for example, reducing to half the input in warmer weather. It can automatically and intelligently seek minimum fuel utilization and appropriate water temperature as weather and other conditions change. By such reduction in water temperature at appropriate times, piping and radiation system heat loss can be minimized and there can be less fluctuation in space temperature for better comfort.

The automatic air/fuel ratio control of the present invention maintains Combustion efficiency and ensures low nitrogen oxide emission under all atmospheric conditions and affords high reliability, improved safety and better combustion.

The sealed combustion can utilize external air for combustion so that indoor heated air is not wasted.

Furthermore, the boiler can be highly compact and wall-mounted so that installation is facilitated.

Finally, the ceramic burner body homogenizes the air and gas mixture to ensure cleaner more intense combustion and thus cleaner emissions. As a consequence, the boiler can be considered to be more environmentally friendly than earlier systems.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
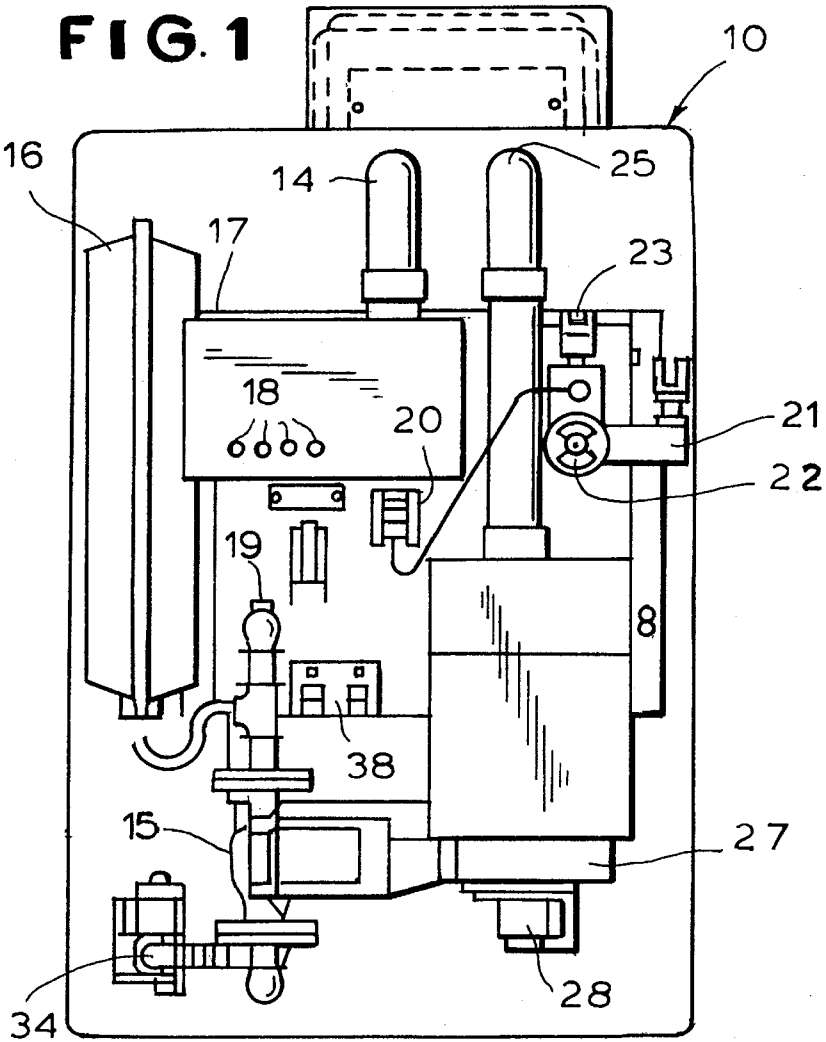
FIG. 1 is an elevational view of the boiler of the invention diagrammatically illustrating a number of the components thereof.
Figure 2:
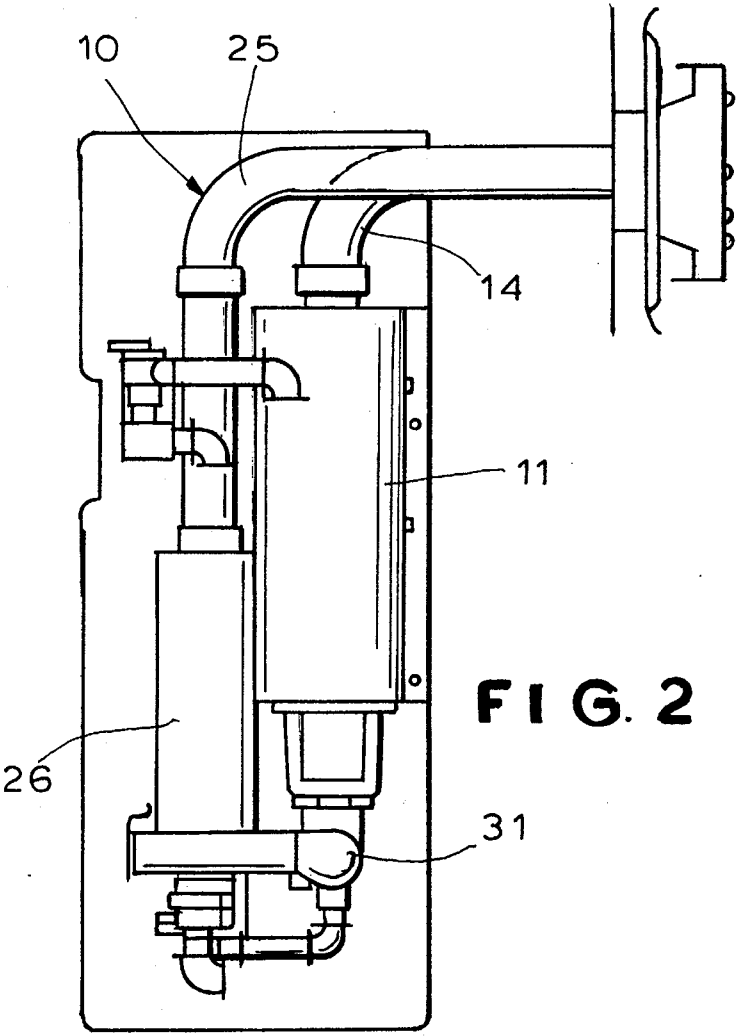
FIG. 2 is a side view thereof.

AS can be seen from FIGS. 1 and 2, the wall-mounted boiler 10 of the present invention can comprise, as is common with all boilers, a heat-exchanger 11 which can be in the form of a chamber 12 traversed by the combustion gases which pass a body of channels 13 through which water is circulated when, for example, the boiler is used for space-heating purposes by the heating of that water.

The gases (FIG. 3) are delivered to the flue 14 opening in a chimney or the like.

As can be seen also from FIGS. 1 and 2, the boiler can include a circulator 15 for the hot water to be used for space-heating purposes, an expansion tank 16 as is common with such systems, the control unit 17 which can have indicator lights 18 signalling status of the application, a low-water cutoff 19 connected to the electronic boiler control 17, a high-limit switch 20, a water-supply manifold 21, a temperature and pressure gauge 22 and an air vent 23.

In the wall-mounted boiler of the invention, external air is used for combustion purposes so that heated interior air does not have to be employed. For that purpose, an air-intake 25 communicates with the exterior and opens into an air-filter box 26 forming a plenum for a blower 27 driven by an electric motor 28 of variable-speed design. The motor 28 (FIG. 3) is provided with a speed control 29 (FIG. 4) which may be housed in the electronic boiler controller 17 and utilizes a microprocessor with a time base represented at 30.

The air is fed through a mixing elbow 31 to the mixing chamber 32 to which gas is fed via a pipe 33 from a linear gas servovalve 34 as will be described in greater detail.

The gas/air mixture is homogenized within a ceramic burner body 35 and is admitted to the combustion chamber 36 where it is ignited by the usual igniter 37 to produce the combustion gases mentioned previously. The combustion gases heat the water circulating in the body 13. A flame sensor 38 may be provided on the combustion chamber to cut off the boiler should the flame fail.

Figure 3:
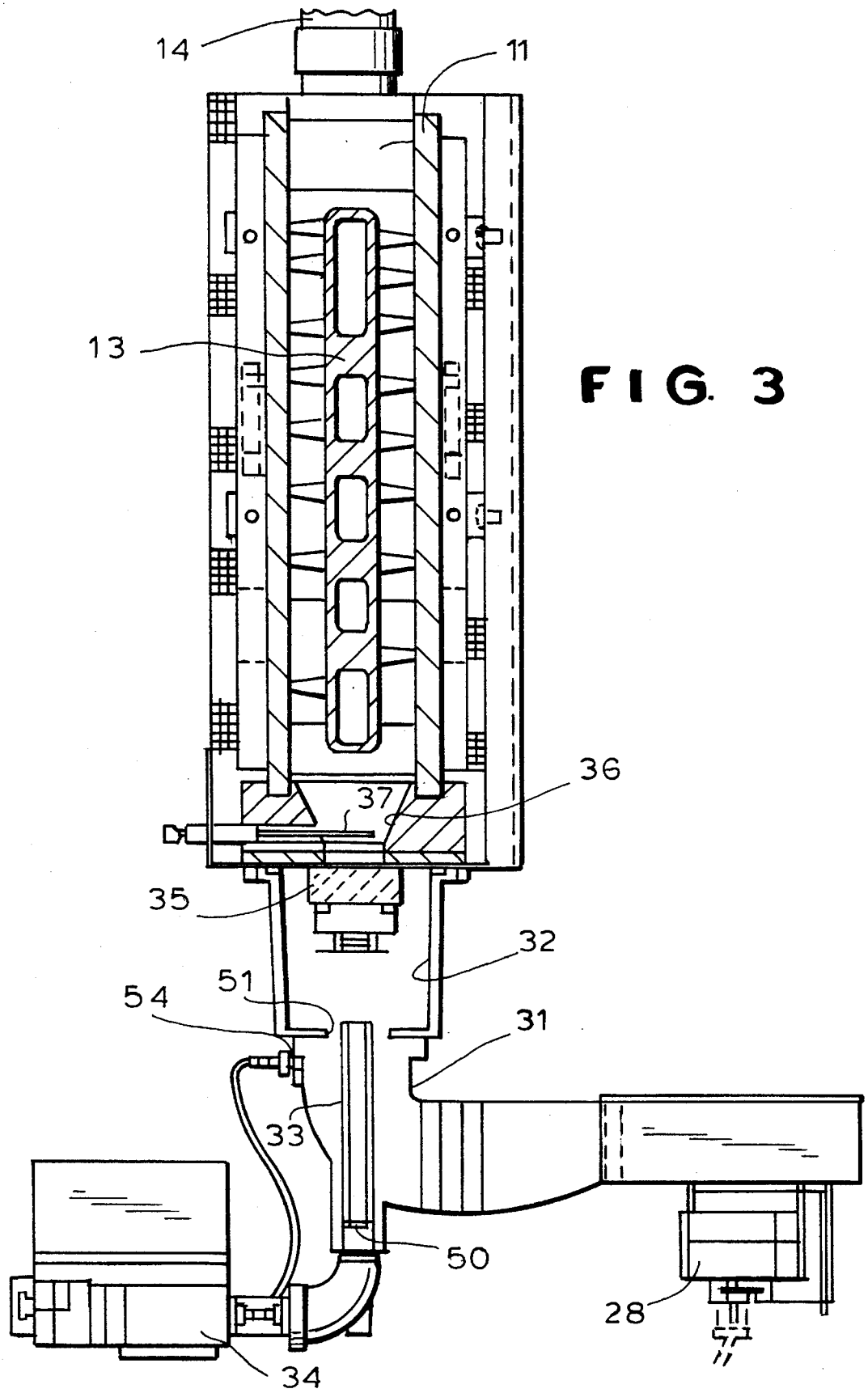
FIG. 3 is a cross section through the boiler, diagrammatically illustrating the air and gas supply system therefor.
Figure 4:
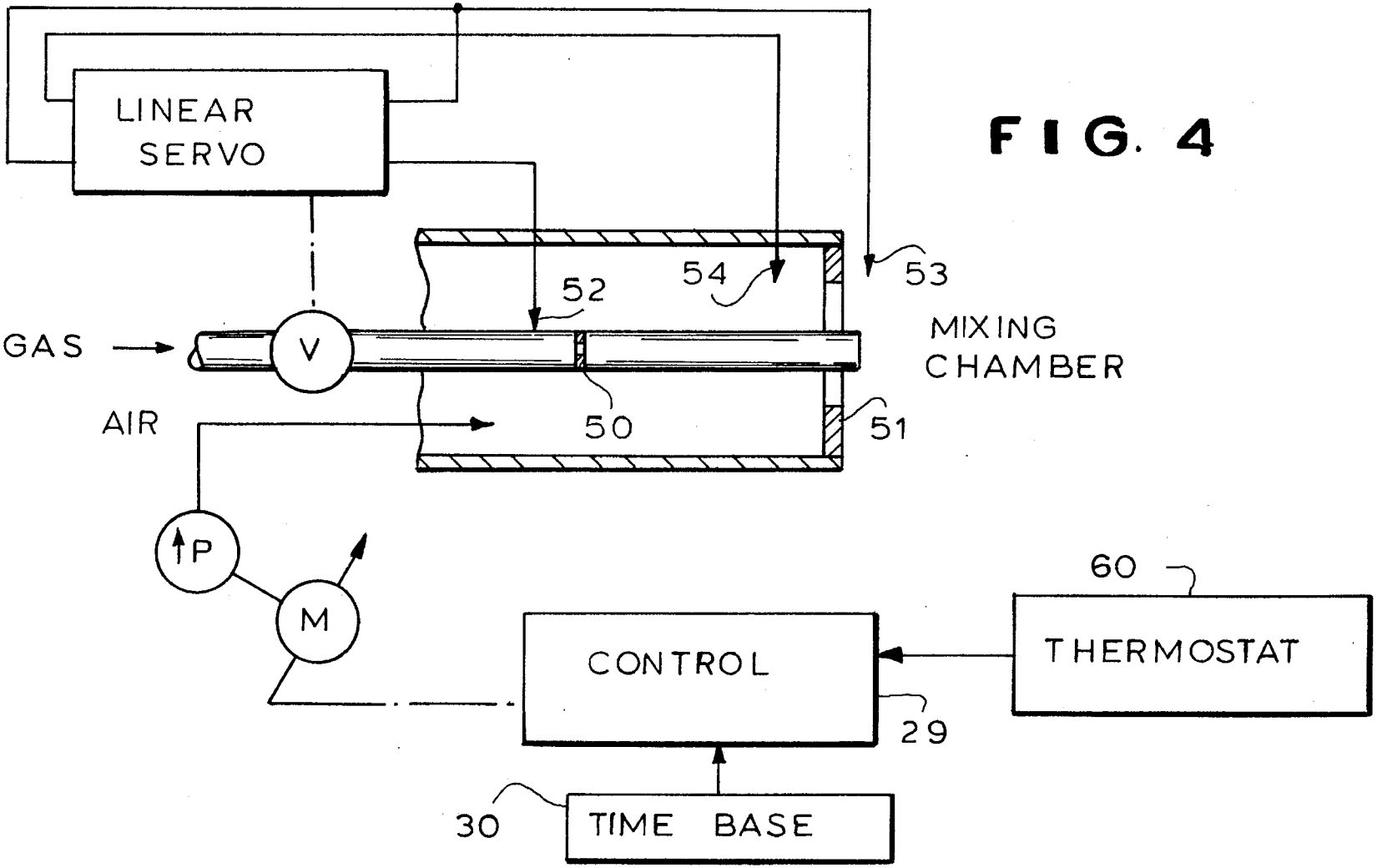
FIG. 4 is a diagram facilitating expansion of the air/gas control according to the invention.

Turning to FIGS. 3 and 4, it can be seen that the linear gas servovalve operates with a gas orifice 50 and an air orifice 51, both of which may be replaceable and which have flow cross sections selected to provide the optimum ratio of air and gas in the combustion mixture. The pressure drop across the gas orifice is detected between a pressure sensor 52 upstream of the orifice 50 and a pressure sensor 53 which can be provided in the mixing chamber or at any event at a location downstream of the two orifices at which the downstream pressures are the same, i.e. a common pressure pickup.

The pressure drop across the air orifice 51 is detected by a pressure pickup or sensor 54 upstream of that orifice and the common pickup 53 previously mentioned. The pressure drop across the air orifice creates an equivalent pressure drop across the gas orifice because the upstream air pressure is applied to the linear servovalve controlling the gas flow.

Since downstream the reference for both the gas and air orifices are equal, the pressure drops across both orifices are equal. Thus, varying the air flow by varying the blower speed, varies the input rate without affecting the air/fuel ratio. Any influence on the air flow can affect the BTU input without affecting emissions.

According to the invention, moreover, the control 17/29 provides automatic boiler input switching utilizing its microprocessor. The burner is preferably operated at two input conditions, namely, full and half-load. Utilizing the time base, the percent "on"-time of the boiler which can be switched on by the conventional thermostat 60, is measured every hour. When the "on"-time is less than a specific percent, the boiler is switched to half rate by reducing the air flow to half, thereby reducing the gas-supply rate to half utilizing the air/fuel ratio control. The policy is switched back to full rate when the "on"-time is more than a given percent. The result is reduced fuel utilization, reduced system losses as well as increased comfort from lower pressure swings. The life of the boiler is increased by the reduced cycling.

Figure 5:
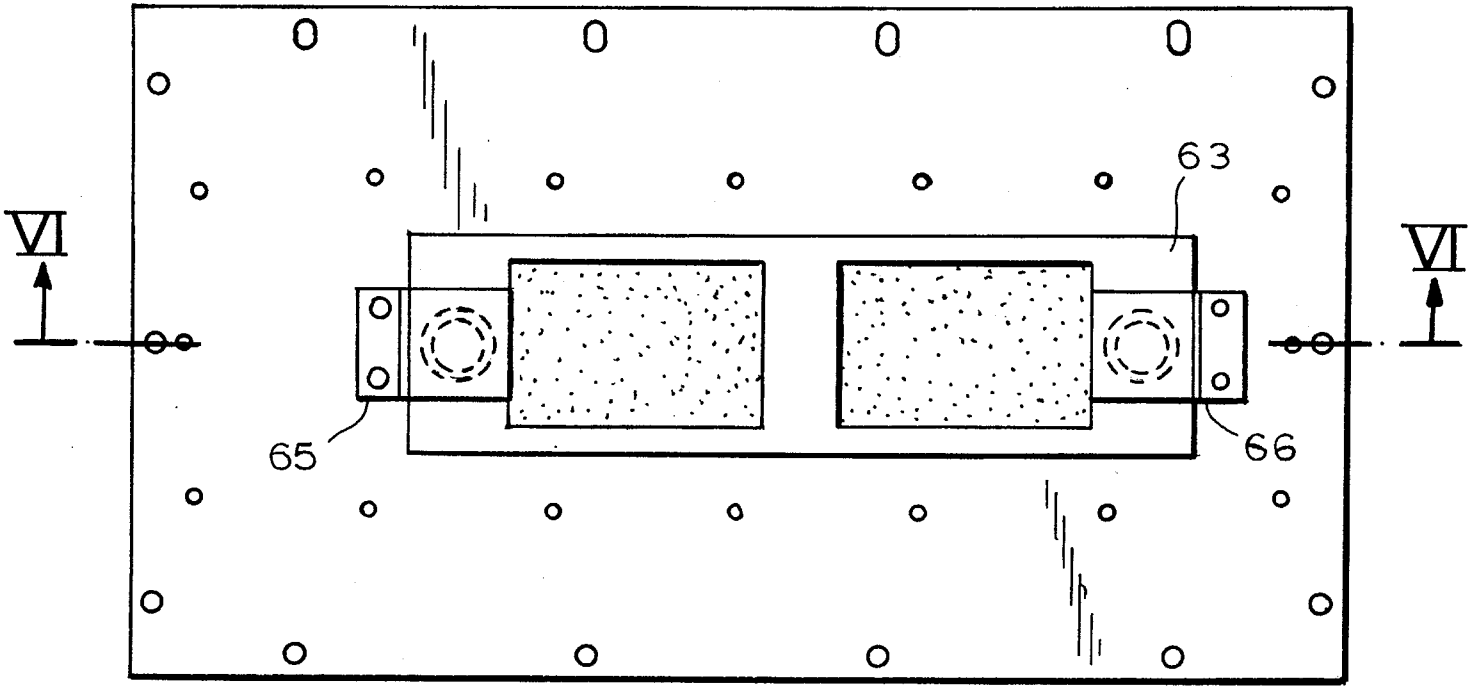
FIG. 5 is an elevational view of the mounting of the ceramic body of the burner sealingly on the wall of the combustion chamber.
Figure 6:
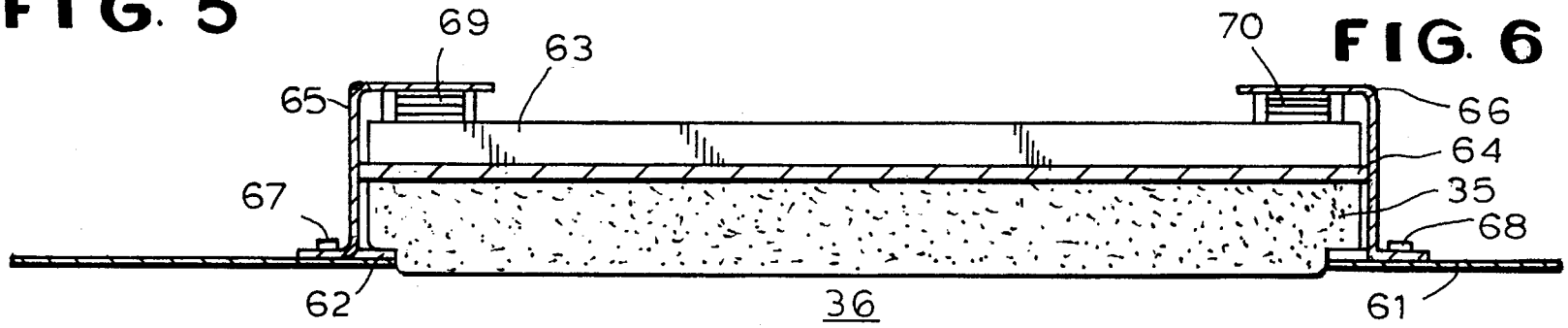
FIG. 6 is a cross sectional view taken along the line VI—VI of FIG. 5.

As can be seen from FIGS. 5 and 6, the ceramic burner body 35 can be mounted in a wall 61 of the combustion chamber 36 by a heat-resistant pliable gasket 62 around the periphery of the ceramic body and a metal frame 63 which presses on the rear of the ceramic body 35 via another heat-resistant pliable gasket 64.

A pair of brackets 65 and 66 at opposite ends of the frame 63 are bolted at 67 and 68 to the wall 61 and form seats for a pair of coil springs 69 and 70 braced against the frame 63. The spring mounting allows the ceramic burner body to seal the combustion chamber and to float on the high-temperature gasket seals, eliminating any problems from any differences in coefficients of expansion.

I claim:

1. A method of operating a gas-fired boiler, comprising the steps of:

(a) feeding a fuel gas to a burner of the boiler through a gas-supply orifice;

(b) feeding air for combustion of said fuel gas to said burner and into admixture with said fuel gas through an air orifice of a cross sectional area dimensioned relative to a cross sectional area of said gas-supply orifice to ensure complete combustion of the fuel gas in said burner;

(c) detecting a pressure drop across said gas-supply orifice and a pressure drop across said air orifices and applying the detected pressure drops to a servovalve controlling flow of the fuel gas to the burner;

(d) regulating said flow with said servovalve to maintain said pressure drops equal with varying air-flow rates to said burner; and (e) turning said boiler on and off to maintain a predetermined temperature range in space heated by said boiler, measuring a proportion of "on"-time of said boiler, and modulating a rate of flow of air to said burner in response to a measured proportion of said "on"-time, thereby varying heat output per unit time in response to demand.

2. The method defined in claim 1 wherein said pressure drops are detected with a common downstream reference for both of said pressure drops.

3. The method defined in claim 1, further comprising the step of feeding a mixture of the air and the fuel gas through a porous ceramic burner body for combustion in a combustion chamber of said boiler.

4. A method of operating a gas-fired boiler, comprising the steps of:

(a) feeding a fuel gas to a burner of the boiler through a gas-supply orifice;

(b) feeding air for combustion of said fuel gas to said burner and into admixture with said fuel gas through an air orifice of a cross sectional area dimensioned relative to a cross sectional area of said gas-supply orifice to ensure complete combustion of the fuel gas in said burner;

(c) detecting a pressure drop across said gas-supply orifice and a pressure drop across said air orifices and applying the detected pressure drops to a servovalve controlling flow of the fuel gas to the burner: (d) regulating said flow with said servovalve to maintain said pressure drops equal with varying air-flow rates to said burner;

(e) feeding a mixture of the air and the fuel gas through a porous ceramic burner body for combustion in a combustion chamber of said boiler; and (f) mounting said porous ceramic burner body in an opening of a wall of said combustion chamber by pressing a metal frame against body and said body against said wall around said opening by a plurality of coil springs braced between brackets anchored to said wall and said frame.

5. The method defined in claim 1 wherein rate of flow of air to the burner is controlled by regulating a speed of an electric motor of an air blower connected to said burner.

6. The method defined in claim 5 wherein said burner is operated in half-load and full-load modes and, upon said "on"-time per hour being less than a predetermined percentage, said burner is switched from full-load mode to half-load mode and upon said "on"-time per hour being more than a predetermined percentage, said burner is switched from half-load mode to full-load mode.

7. A gas-fired boiler, comprising:

a burner comprising a porous ceramic burner body;

a combustion chamber receiving a combustible mixture from said burner and provided with a flue and means for heating water;

means for feeding a fuel gas to said burner through a gas-supply orifice;

means for feeding air for combustion of said fuel gas to said burner and into admixture with said fuel gas through an air orifice of a cross sectional area dimensioned relative to a cross sectional area of said gas-supply orifice to ensure complete combustion of the fuel gas in said burner;

means for detecting a pressure drop across said gas-supply orifice and a pressure drop across said air orifices;

a servovalve controlling flow of the fuel gas to the burner and provided with inputs representing said pressure drops, said servovalve regulating said flow to maintain said pressure drops equal with varying air-flow rates to said burner, said pressure drops being detected with a common downstream reference for both of said pressure drops; and means for mounting said porous ceramic burner body in an opening of a wall of said combustion chamber and including a metal frame pressed against body and pressing said body against said wall, add a plurality of coil springs braced between brackets anchored to said wall and said frame.

8. The boiler defined in claim 7, further comprising control means for turning said boiler on and off to maintain a predetermined temperature range in space heated by said boiler, measuring a proportion of "on"-time of said boiler, and means for modulating a rate of flow of air to said burner in response to a measured proportion of said "on"-time, thereby varying heat output per unit time in response to demand.

9. The boiler defined in claim 8 wherein said means for modulating is a variable speed electric motor, and a blower driven by said motor and connected to said burner.

10. The boiler defined in claim 9 wherein said control means includes means for operating said burner in half-load and full-load modes and, upon said "on"-time per hour being less than a predetermined percentage, for switching said burner from full-load mode to half-load mode and, upon said "on"-time per hour being more than a predetermined percentage, for switching said burner from half-load mode to full-load mode.

11. A gas-fired boiler, comprising:

a burner;

a combustion chamber receiving a combustible mixture from said burner and provided with a flue and means for heating water;

means for feeding a fuel gas to said burner through a gas-supply orifice;

means for feeding air for combustion of said fuel gas to said burner and into admixture with said fuel gas through an air orifice of a cross sectional area dimensioned relative to a cross sectional area of said gas-supply orifice to ensure complete combustion of the fuel gas in said burner;

means for detecting a pressure drop across said gas-supply orifice and a pressure drop across said air orifices;

a servovalve controlling flow of the fuel gas to the burner and provided with inputs representing said pressure drops, said servovalve regulating said flow to maintain said pressure drops equal with varying air-flow rates to said burner;

control means for turning said boiler on and off to maintain a predetermined temperature range in space heated by said boiler;

means for measuring a proportion of "on"-time of said boiler; and means for modulating a rate of flow of air to said burner in response to a measured proportion of said "on"-time, thereby varying heat output per unit time in response to demand.

12. The boiler defined in claim 11 wherein said means for modulating is a variable speed electric motor, and a blower driven by said motor and connected to said burner.

13. The boiler defined in claim 12 wherein said control means includes means for operating said burner in half-load and full-load modes and, upon said "on"-time per hour being less than a predetermined percentage, for switching said burner from full-load mode to half-load mode and, upon said "on"-time per hour being more than a predetermined percentage, for switching said burner from half-load mode to full-load mode.

* * * * *